US011653798B1

(12) United States Patent
McDuffie

(10) Patent No.: US 11,653,798 B1
(45) Date of Patent: May 23, 2023

(54) TOILET SEAT LIFT ASSEMBLY

(71) Applicant: Jean McDuffie, Jacksonville, AL (US)

(72) Inventor: Jean McDuffie, Jacksonville, AL (US)

( * ) Notice: Subject to any disclaimer, the term of this patent is extended or adjusted under 35 U.S.C. 154(b) by 50 days.

(21) Appl. No.: 17/537,698

(22) Filed: Nov. 30, 2021

(51) Int. Cl.
*A47K 13/10* (2006.01)
*A61G 7/10* (2006.01)

(52) U.S. Cl.
CPC ..... *A47K 13/10* (2013.01); *A61G 7/1007* (2013.01); *A61G 7/1017* (2013.01); *A61G 7/1044* (2013.01); *A61G 7/1059* (2013.01); *A61G 2203/12* (2013.01)

(58) Field of Classification Search
CPC ..... A47K 13/10
See application file for complete search history.

(56) References Cited

U.S. PATENT DOCUMENTS 5,592,703 A 1/1997 Jones
6,189,164 B1 2/2001 Krapu
6,360,382 B1 3/2002 Karash
6,449,783 B1 * 9/2002 Moser ..... A61G 7/1094 4/667
6,553,585 B1 4/2003 Lunstrom
6,598,246 B1 * 7/2003 Shou ..... A61G 7/1094 297/DIG. 10
6,754,917 B1 6/2004 Rhoades
7,900,297 B2 3/2011 Peng
2007/0209111 A1 9/2007 Boger
2009/0313753 A1 12/2009 Campbell
2013/0232686 A1 9/2013 Schwartz
2014/0230142 A1 * 8/2014 Baker ..... A47K 13/10 4/667
2020/0029755 A1 * 1/2020 Roff ..... A47K 13/10
2020/0170862 A1 * 6/2020 Song ..... A47K 17/026

* cited by examiner

*Primary Examiner* — Christine J Skubinna

(57) ABSTRACT

A toilet seat lift assembly includes a toilet seat that is mountable to a toilet and the toilet seat has a lower half and an upper half. A set of first brackets is each movably coupled between the lower half and the upper half of the toilet seat. A set of second brackets is each movably coupled between the lower half and the upper half of the toilet seat. A lifting unit is movably coupled to the upper half of the toilet seat for urging the upper half into a home position or a deployed position. A remote control is in communication with the lifting unit for remotely actuating the lifting unit into the lowering condition or the lifting condition. In this way the remote control facilitates a person to either lift or lower themselves onto the toilet.

7 Claims, 5 Drawing Sheets

TOILET SEAT LIFT ASSEMBLY

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

The disclosure relates to toilet lift devices and more particularly pertains to a new toilet lift device for facilitating a physically limited user to employ a toilet without assistance. The device includes a toilet seat which comprises an upper half and a lower half, and the lower half is mounted to the toilet. A lifting unit is coupled to the upper half to either lift the upper half into a deployed position or lower the upper half onto the lower half. The device includes a remote control to facilitate the physically limited user to remotely control the lifting unit. In this way the physically limited user can either lower themselves onto the toilet or lift themselves from the toilet without assistance.

(2) Description of Related Art Including Information Disclosed Under 37 CFR 1.97 and 1.98

The prior art relates to toilet lift devices including a variety of toilet lifts that include a toilet seat, which includes side rails, and a lifting unit that lifts the toilet seat upwardly from a toilet or lowers the toilet seat onto the toilet. In each case the toilet seat is oriented at an angle when the toilet seat is lifted to facilitate a user to position themselves against the toilet seat without assistance. The prior art discloses a variety of toilet lifts that each includes a toilet seat and a lifting unit that lifts the toilet seat upwardly from the toilet along a vertical axis. In each case the toilet seat remains in a horizontal orientation when the toilet seat is lifted or lowered. In no instance does the prior art disclose a toilet seat that comprises an upper half and a lower half having the lower half being mounted to a toilet and having a lifting unit which lifts or lowers the upper half of the toilet seat.

BRIEF SUMMARY OF THE INVENTION

An embodiment of the disclosure meets the needs presented above by generally comprising a toilet seat that is mountable to a toilet and the toilet seat has a lower half and an upper half. A set of first brackets is each movably coupled between the lower half and the upper half of the toilet seat. A set of second brackets is each movably coupled between the lower half and the upper half of the toilet seat. A lifting unit is movably coupled to the upper half of the toilet seat for urging the upper half into a home position or a deployed position. A remote control is in communication with the lifting unit for remotely actuating the lifting unit into the lowering condition or the lifting condition. In this way the remote control facilitates a person to either lift or lower themselves onto the toilet.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
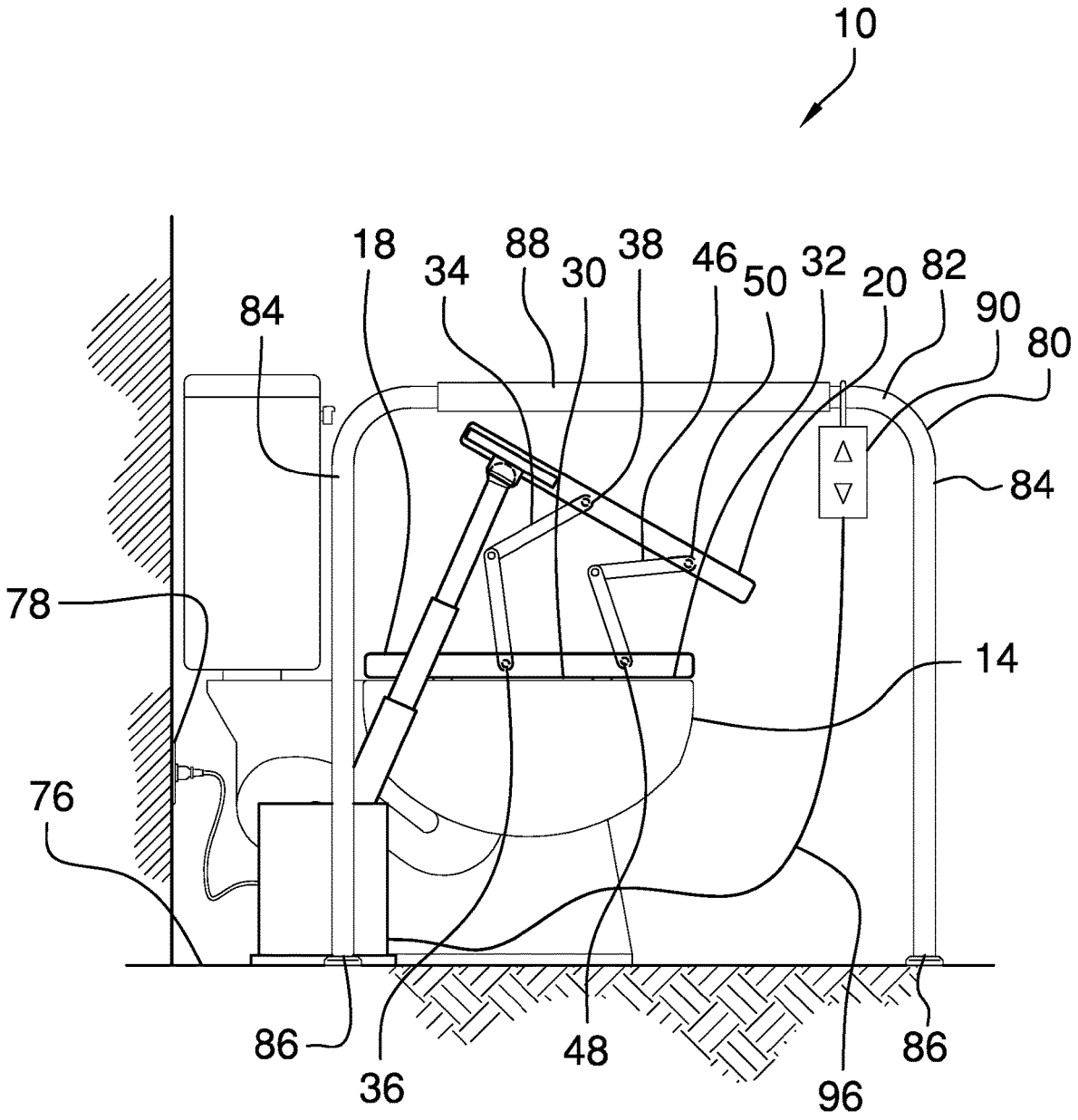
FIG. 1 is a right side in-use view of a toilet seat lift assembly according to an embodiment of the disclosure.
Figure 2:
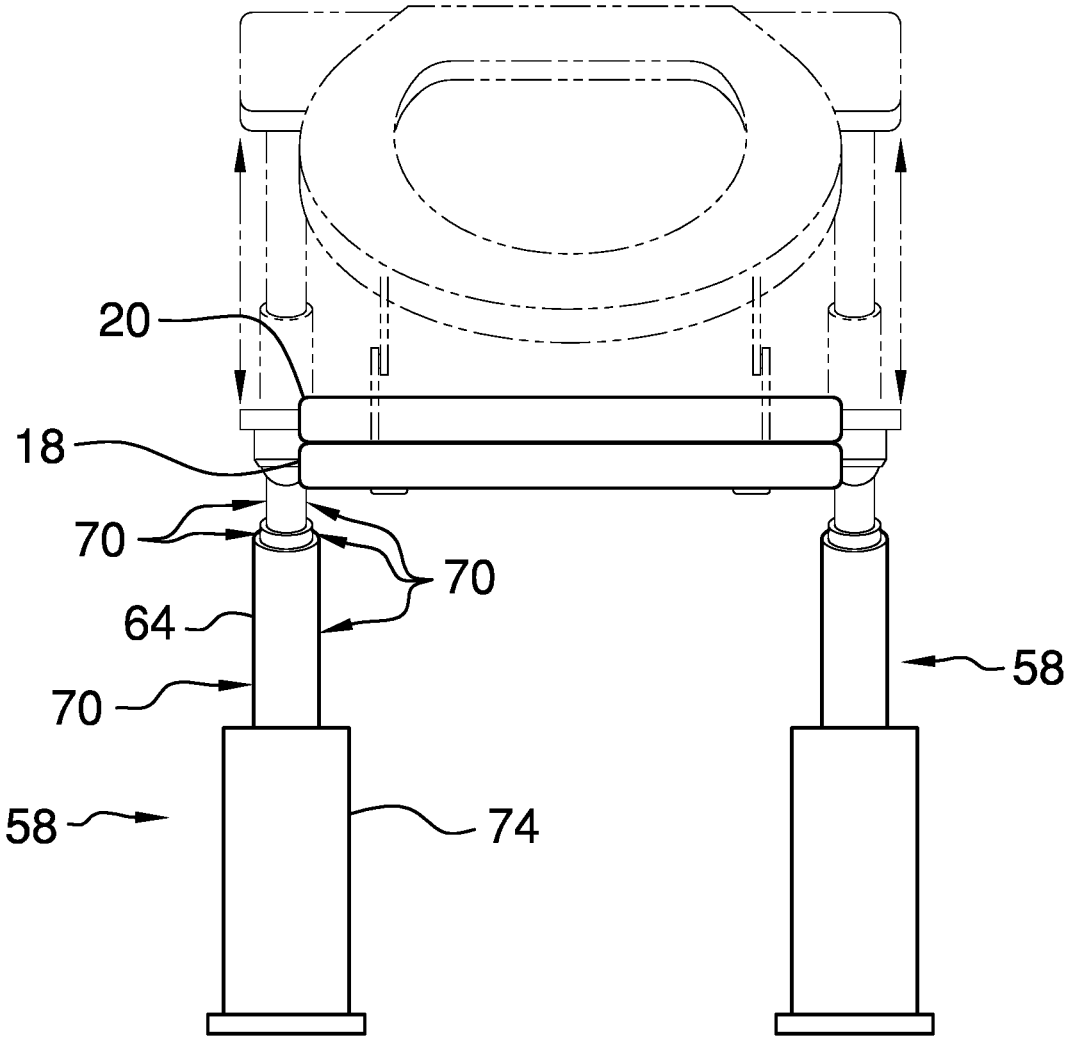
FIG. 2 is a front view of an embodiment of the disclosure.
Figure 3:
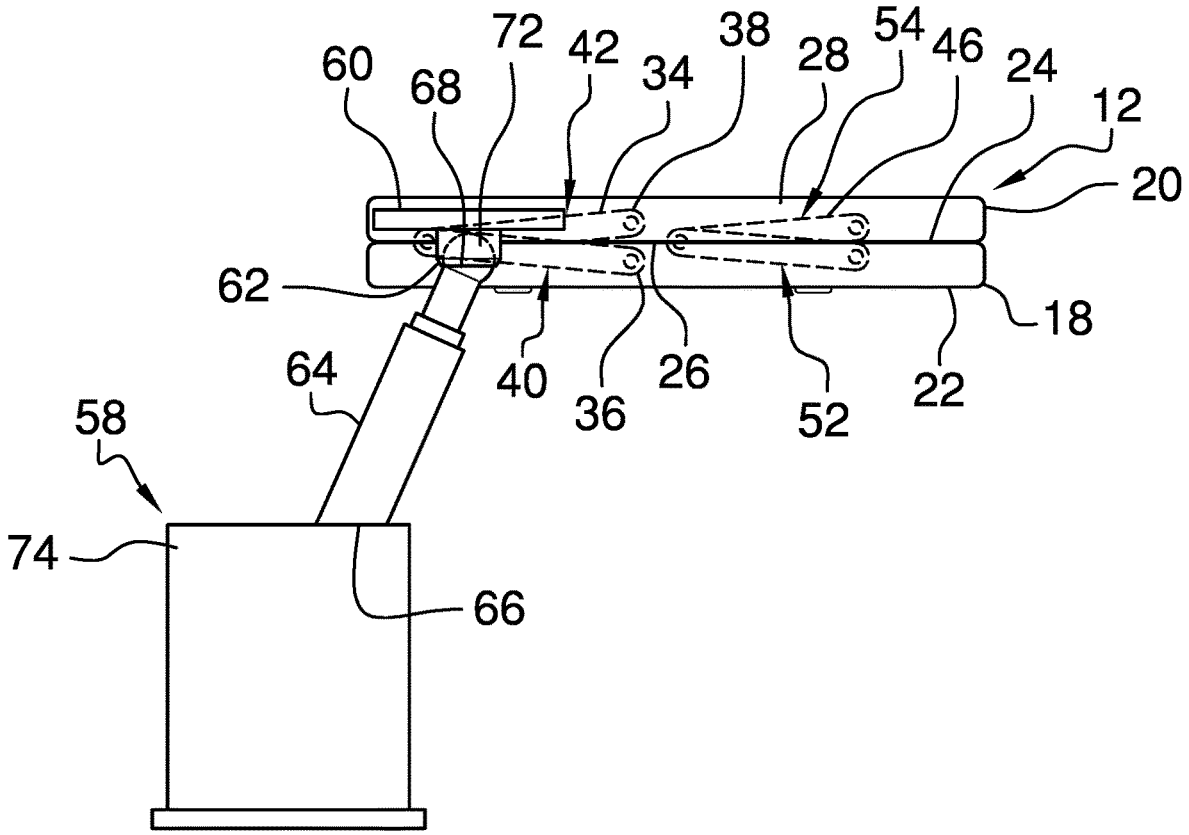
FIG. 3 is a right side phantom view of an embodiment of the disclosure.
Figure 4:
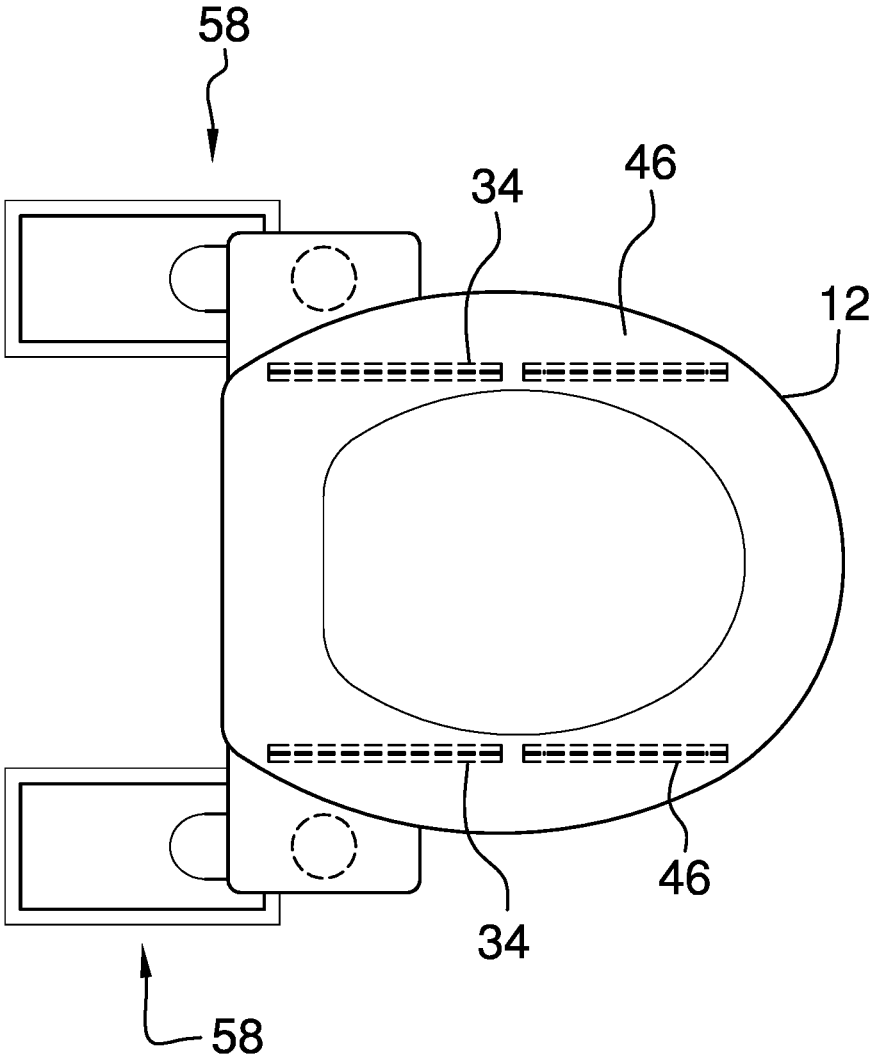
FIG. 4 is a top phantom view of an embodiment of the disclosure.
Figure 5:
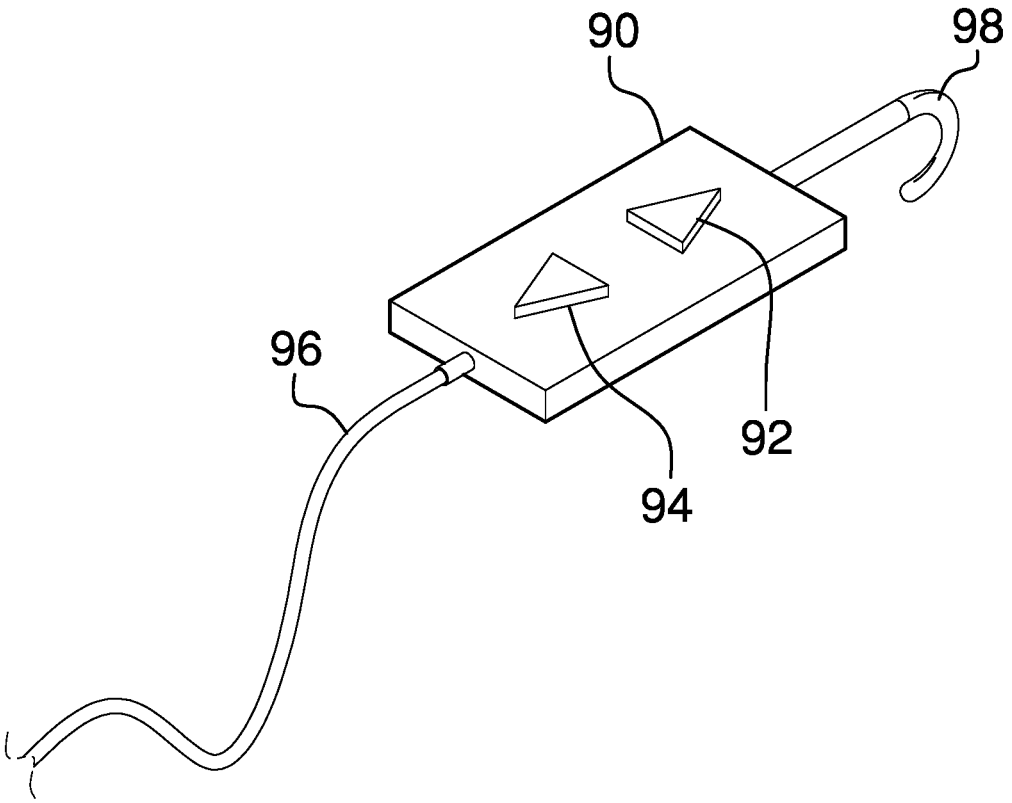
FIG. 5 is a perspective view of a remote control of an embodiment of the disclosure.

With reference now to the drawings, and in particular to FIGS. 1 through 5 thereof, a new toilet lift device embodying the principles and concepts of an embodiment of the disclosure and generally designated by the reference numeral 10 will be described.

As best illustrated in FIGS. 1 through 5, the toilet seat lift assembly 10 generally comprises a toilet seat 12 that is mountable to a toilet 14 such that the toilet seat 12 can be sat upon by a person 16 employing the toilet 14. The toilet 14 may be a plumbing fixture in a bathroom and the toilet 14 may be of any conventional design. The toilet seat 12 has a lower half 18 and an upper half 20. The lower half 18 has a bottom side 22 and a top side 24, and the upper half 20 has a lower side 26 and an upper side 28. The bottom side 22 of the lower half 18 is mounted to a top 30 of a bowl 32 of the toilet 14. The lower side 26 of the upper half 20 rests on the top side 24 of the lower half 18 when the upper half 20 is in a home position.

A set of first brackets 34 is provided and each of the first brackets 34 is movably coupled between the lower half 18 and the upper half 20 of the toilet seat 12. Each of the first brackets 34 has a first end 36 and a second end 38, and the first end 36 of each of the first brackets 34 is pivotally coupled to the lower half 18. Additionally, the second end 38 of each of the first brackets 34 is pivotally coupled to the upper half 20. Each of the first brackets 34 comprises a first portion 40 is pivotally coupled to a second portion 42, and each of the first brackets 34 is collapsed when the upper half 20 is in the home position. The second end 38 of each of the first brackets 34 engages the upper half 20 at a point that is located adjacent to a rear end 44 of the upper half 20.

A set of second brackets 46 is included and each of the second brackets 46 is movably coupled between the lower half 18 and the upper half 20 of the toilet seat 12. Each of the second brackets 46 has a first end 48 and a second end 50. The first end 48 of each of the second brackets 46 is pivotally coupled to the lower half 18 and the second end 50 of each of the second brackets 46 is pivotally coupled to the upper half 20. Each of the second brackets 46 comprises a first portion 52 that is pivotally coupled to a second portion 54, and each of the second brackets 46 is collapsed when the upper half 20 is in the home position. Furthermore, the second end 50 of each of the second brackets 46 engages the upper half 20 at a point that is located adjacent to a front end 56 of the upper half 20.

Each of the second brackets 46 has a length that is less than a length of the first brackets 34. In this way the upper half 20 of the toilet seat 12 is oriented at a downwardly sloping angle with respect to the lower half 18 when the upper half 20 is positioned in a deployed position. Moreover, each of the first brackets 34 and the second brackets 46 extends between the lower half 18 and the upper half 20 when the upper half 20 is positioned in the deployed position. In this way the upper half 20 is positioned facilitate the person 16 to sit on the upper half 20 without assistance. The person 16 might be an elderly person, a physically disabled person or any other person that typically requires assistance to sit on or stand up from a toilet.

A pair of lifting units 58 is provided and each of the lifting units 58 is movably coupled to the upper half 20 of the toilet seat 12. The lifting units 58 are actuatable into a lowering condition for urging the upper half 20 into the home position. Conversely, the lifting units 58 are actuatable into a lifting condition for urging the upper half 20 in to the deployed position. Each of the lifting units 58 comprises a mount 60 that is integrated into the lower side 26 of the upper half 20 of the toilet seat 12. The mount 60 is positioned between the first brackets 34 and the rear end of the upper half 20, and the mount 60 includes a cup 62 extending downwardly from the lower side 26.

The lifting units 58 include an actuator 64 which has a lower end 66 and an upper end 68. The actuator 64 comprises a plurality of sections 70 that each slidably engages each other such that the actuator 64 has a telescopically adjustable length. The actuator 64 is elongated between the lower end 66 and the upper end 68 when the actuator 64 is actuated into an extended condition. Conversely, the actuator 64 is collapsed between the lower end 66 and the upper end 68 when the actuator 64 is actuated into a collapsed condition. The actuator 64 may be an electro-mechanical linear actuator or other type of actuator that can elongate or shorten. A ball 72 is coupled to the upper end 68 of the actuator 64 and the ball 72 engages the cup 62 on the mount 60 such that the upper end 68 is pivotally engaged to the mount 60.

The lifting units 58 include a motor 74 that is positioned on a support surface 76 at a point that is located adjacent to the toilet 14, and the lower end 66 of the actuator 64 is in communication with the motor 74. The motor 74 urges the actuator 64 into the extended condition when the motor 74 is actuated into a first condition. Conversely, the motor 74 urges the actuator 64 into the collapsed condition when the motor 74 is actuated into a second condition. The motor 74 is electrically coupled to a power source 78 comprising an electrical system of a bathroom in which the toilet 14 is positioned. The motor 74 may comprise an electric motor, a hydraulic pump or other type of energy source that can power the actuator 64. Each of the lifting units 58 might be positioned on opposite sides of the toilet from each other.

A pair of rails 80 is provided and each of the rails 80 is mounted to the support surface 76 upon which the toilet 14 is positioned. Each of the rails 80 is positioned on opposite sides of the toilet 14 with respect to each other. In this way each of the rails 80 can be gripped by the person 16 to facilitate the person 16 to stabilize themselves when the person 16 is being lowered or lifted onto the toilet 14. Each of the rails 80 has a central member 82 extending between a pair of upright members 84, and each of the upright members 84 has a distal end 86 with respect to the central member 82. The distal end 86 of each of the upright members 84 of each of the rails 80 is coupled to the support surface 76 upon which the toilet 14. Thus, the central member 82 of each of the rails 80 is oriented to extend along a horizontal axis thereby facilitating the person 16 to grip the central member 82. The central member 82 of each of the rails 80 may have a cushion 88 extending around the central member 82 for enhancing comfort of the person 16.

A remote control 90 is provided and the remote control 90 is in communication with the lifting units 58 for remotely actuating the lifting units 58 into the lowering condition or the lifting condition. In this way the remote control 90 facilitates the person 16 to either lift or lower themselves onto the toilet 14. The remote control 90 has a lift button 92 and a lower button 94, and the remote control 90 includes a conductor 96 that is electrically coupled between the remote control 90 and the motor 74 of the lifting units 58. The lift button 92 actuates the motor 74 into the first condition when the lift button 92 is depressed, and the lower button 94 actuates the motor 74 into the second condition when the lower button 94 is depressed. Additionally, the remote control 90 includes a hook 98 which extends away from the remote control 90 and which can be positioned around the central member 82 of a respective one of the rails 80 for storing the remote control 90.

In use, the person 16 employs the remote control 90 to actuate the lifting units 58 into the lifting condition for urging the upper half 20 of toilet seat 12 into the deployed position. In this way the person 16 can position themselves against the upper side 28 of the upper half 20 of the toilet seat 12 and subsequently employ the remote control 90 to actuate the lifting units 58 into the lowering condition. In this way the person 16 can lower themselves onto the toilet 14 without assistance to employ the toilet 14. The person 16 employs the remote control 90 to actuate the lifting units 58 into the lifting condition for urging the upper half 20 of the toilet seat 12 into the deployed position when the person 16 has finished employing the toilet 14. In this way the person 16 can lift themselves into a standing position without assistance.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A toilet seat lift assembly for assisting a disabled person to sit on and stand up from a toilet seat, said assembly comprising:

a toilet seat being mountable to a toilet wherein said toilet seat is configured to be sat upon by a person employing the toilet, said toilet seat having a lower half and an upper half;

a set of first brackets, each of said first brackets being movably coupled between said lower half and said upper half of said toilet seat;

a set of second brackets, each of said second brackets being movably coupled between said lower half and said upper half of said toilet seat;

a lifting unit being movably coupled to said upper half of said toilet seat, said lifting unit being actuatable into a lowering condition for urging said upper half into a home position, said lifting unit being actuatable into a lifting condition for urging said upper half into a deployed position;

a pair of rails, each of said rails being mounted to the support surface upon which the toilet is positioned, each of said rails being positioned on opposite sides of the toilet with respect to each other wherein each of said rails is configured to be gripped by the person to facilitate the person to stabilize themselves when the person is being lowered or lifted onto the toilet; and a remote control being in communication with said lifting unit for remotely actuating said lifting unit into said lowering condition or said lifting condition wherein said remote control is configured to facilitate the person to either lift or lower themselves onto the toilet.

2. The assembly according to claim 1, wherein:

said lower half of said toilet seat has a bottom side and a top side, said upper half of said toilet seat having a lower side and an upper side, said bottom side of said lower half being mounted to a top of a bowl of the toilet, said lower side of said upper half lying on said top side of said lower half when said upper half is in a home position;

each of said first brackets has a first end and a second end, said first end of each of said first brackets being pivotally coupled to said lower half, said second end of each of said first brackets being pivotally coupled to said second half, each of said first brackets comprising a first portion being pivotally coupled to a second portion, each of said first brackets being collapsed when said upper half is in said home position, said second end of each of said first brackets engaging said upper half at a point being located adjacent to a rear end of said upper half; and each of said second brackets has a first end and a second end, said first end of each of said second brackets being pivotally coupled to said lower half, said second end of each of said second brackets being pivotally coupled to said second half, each of said second brackets comprising a first portion being pivotally coupled to a second portion, each of said second brackets being collapsed when said upper half is in said home position, said second end of each of said second brackets engaging said upper half at a point being located adjacent to a front end of said upper half.

3. The assembly according to claim 2, wherein each of said second brackets has a length being less than a length of said first brackets such that said upper half is oriented at a downwardly sloping angle with respect to said lower half when said upper half is positioned in a deployed position having each of said first brackets and said second brackets being extended between said lower half and said upper half wherein said upper half is configured to facilitate the person to sit on said upper half without assistance.

4. The assembly according to claim 2, wherein said lifting unit comprising:

a mount being integrated into said lower side of said upper half of said toilet seat, said mount being positioned between said first brackets and said rear end of said upper half, said mount including a cup extending downwardly from said lower side;

an actuator having a lower end and an upper end, said actuator comprising a plurality of sections each slidably engaging each other such that said actuator has a telescopically adjustable length, said actuator being elongated between said lower end and said upper end when said actuator is actuated into an extended condition, said actuator being collapsed between said lower end and said upper end when said actuator is actuated into a collapsed condition;

a ball being coupled to said upper end of said actuator, said ball engaging said cup on said mount such that said upper end is pivotally engaged to said mount; and a motor being positioned on a support surface at a point being located adjacent to the toilet, said lower end of said actuator being in communication with said motor, said motor urging said actuator into said extended condition when said motor is actuated into a first condition, said motor urging said actuator into said collapsed condition when said motor is actuated into a second condition, said motor being electrically coupled to a power source comprising an electrical system of a bathroom in which the toilet is positioned.

5. The assembly according to claim 1, wherein each of said rails has a central member extending between a pair of upright members, each of said upright members having a distal end with respect to said central member, said distal end of each of said upright members of each of said rails being coupled to the support surface upon which the toilet is positioned such that said central member of each of said rails is oriented to extend along a horizontal axis wherein said central member of each of said rails is configured to be gripped by the person.

6. The assembly according to claim 4, wherein said remote control has a lift button and a lower button, said remote control including a conductor being electrically coupled between said remote control and said motor of said lifting unit, said lift button actuating said motor into said first condition when said lift button is depressed, said lower button actuating said motor into said second condition when said lower button is depressed, said remote control including a hook extending away from said remote control, said hook being positionable around a central member of a respective one of said rails for storing said remote control.

7. A toilet seat lift assembly for assisting a disabled person to sit on and stand up from a toilet seat, said assembly comprising:

a toilet seat being mountable to a toilet wherein said toilet seat is configured to be sat upon by a person employing the toilet, said toilet seat having a lower half and an upper half, said lower half having a bottom side and a top side, said upper half having a lower side and an upper side, said bottom side of said lower half being mounted to a top of a bowl of the toilet, said lower side of said upper half lying on said top side of said lower half when said upper half is in a home position;

a set of first brackets, each of said first brackets being movably coupled between said lower half and said upper half of said toilet seat, each of said first brackets having a first end and a second end, said first end of each of said first brackets being pivotally coupled to said lower half, said second end of each of said first brackets being pivotally coupled to said second half, each of said first brackets comprising a first portion being pivotally coupled to a second portion, each of said first brackets being collapsed when said upper half is in said home position, said second end of each of said first brackets engaging said upper half at a point being located adjacent to a rear end of said upper half;

a set of second brackets, each of said second brackets being movably coupled between said lower half and said upper half of said toilet seat, each of said second brackets having a first end and a second end, said first end of each of said second brackets being pivotally coupled to said lower half, said second end of each of said second brackets being pivotally coupled to said second half, each of said second brackets comprising a first portion being pivotally coupled to a second portion, each of said second brackets being collapsed when said upper half is in said home position, said second end of each of said second brackets engaging said upper half at a point being located adjacent to a front end of said upper half, each of said second brackets having a length being less than a length of said first brackets such that said upper half is oriented at a downwardly sloping angle with respect to said lower half when said upper half is positioned in a deployed position having each of said first brackets and said second brackets being extended between said lower half and said upper half wherein said upper half is configured to facilitate the person to sit on said upper half without assistance;

a lifting unit being movably coupled to said upper half of said toilet seat, said lifting unit being actuatable into a lowering condition for urging said upper half into said home position, said lifting unit being actuatable into a lifting condition for urging said upper half in to said deployed position, said lifting unit comprising:

a mount being integrated into said lower side of said upper half of said toilet seat, said mount being positioned between said first brackets and said rear end of said upper half, said mount including a cup extending downwardly from said lower side;

an actuator having a lower end and an upper end, said actuator comprising a plurality of sections each slidably engaging each other such that said actuator has a telescopically adjustable length, said actuator being elongated between said lower end and said upper end when said actuator is actuated into an extended condition, said actuator being collapsed between said lower end and said upper end when said actuator is actuated into a collapsed condition;

a ball being coupled to said upper end of said actuator, said ball engaging said cup on said mount such that said upper end is pivotally engaged to said mount; and a motor being positioned on a support surface at a point being located adjacent to the toilet, said lower end of said actuator being in communication with said motor, said motor urging said actuator into said extended condition when said motor is actuated into a first condition, said motor urging said actuator into said collapsed condition when said motor is actuated into a second condition, said motor being electrically coupled to a power source comprising an electrical system of a bathroom in which the toilet is positioned;

a pair of rails, each of said rails being mounted to the support surface upon which the toilet is positioned, each of said rails being positioned on opposite sides of the toilet with respect to each other wherein each of said rails is configured to be gripped by the person to facilitate the person to stabilize themselves when the person is being lowered or lifted onto the toilet, each of said rails having a central member extending between a pair of upright members, each of said upright members having a distal end with respect to said central member, said distal end of each of said upright members of each of said rails being coupled to the support surface upon which the toilet is positioned such that said central member of each of said rails is oriented to extend along a horizontal axis wherein said central member of each of said rails is configured to be gripped by the person; and a remote control being in communication with said lifting unit for remotely actuating said lifting unit into said lowering condition or said lifting condition wherein said remote control is configured to facilitate the person to either lift or lower themselves onto the toilet, said remote control having a lift button and a lower button, said remote control including a conductor being electrically coupled between said remote control and said motor of said lifting unit, said lift button actuating said motor into said first condition when said lift button is depressed, said lower button actuating said motor into said second condition when said lower button is depressed, said remote control including a hook extending away from said remote control, said hook being positionable around said central member of a respective one of said rails for storing said remote control.

* * * * *